US006457194B1

(12) United States Patent
Bennett

(10) Patent No.: US 6,457,194 B1
(45) Date of Patent: Oct. 1, 2002

(54) BED LINEN HOLDER AND METHOD

(76) Inventor: Bruce Allan Bennett, 15 Chestnut Ave., San Rafael, CA (US) 94901

( * ) Notice: Subject to any disclaimer, the term of this patent is extended or adjusted under 35 U.S.C. 154(b) by 0 days.

(21) Appl. No.: 09/819,106

(22) Filed: Mar. 27, 2001

(51) Int. Cl.[7] ..... A47C 21/02
(52) U.S. Cl. ..... 5/504.1; 5/498; 5/658; 24/72.5
(58) Field of Search ..... 5/504.1, 503.1, 5/658, 659, 498; 24/72.5

(56) References Cited

U.S. PATENT DOCUMENTS 1,508,643 A * 9/1924 Brokaw ..... 5/498 X
4,400,836 A * 8/1983 Pelura ..... 5/498
4,520,518 A * 6/1985 Reaser ..... 5/498
4,635,308 A * 1/1987 Maggio et al. ..... 5/658
4,794,660 A * 1/1989 Hawkrigg ..... 5/498
4,967,434 A * 11/1990 Hill ..... 5/658

* cited by examiner

*Primary Examiner*—Robert G. Santos
(74) *Attorney, Agent, or Firm*—Risto A. Rinne, Jr.

(57) ABSTRACT

An apparatus and method for securing a bed linen proximate a mattress includes a planar member with at least one tapered portion that is adapted to receive a portion of a bed linen therein. In use, the bed linen is urged into the tapered portion and is secured thereto. The planar member is then rotated approximately 180 degrees and is placed under a corner of the mattress, thereby securing the corner of the linen in position under the mattress. Alternate embodiments for the planar member and for the tapered portion are described.

19 Claims, 5 Drawing Sheets

BED LINEN HOLDER AND METHOD

BACKGROUND OF THE INVENTION

1. Field of the Invention

The present invention, in general relates to bed accessories and, more particularly, to devices that hold a bed sheet or a blanket in position proximate a mattress on a bed.

As is customary in our culture, the proper making of a bed typically includes the use of both a top and a bottom sheet. As is well known in the bed and linen arts, a person sleeps intermediate the top and the bottom sheets.

If a box spring is used under the mattress the sheets are tucked under the mattress so that a portion of the sheets are disposed intermediate the top plane of the box spring and the bottom plane of the mattress.

If the box spring is eliminated and the mattress is placed on a platform support (i.e., a flat base) or directly on the floor, the sheets are tucked under the mattress so that a portion of the sheets are disposed under the mattress and intermediate the platform support or the floor.

The bottom sheet may be a flat sheet or it may be a "fitted" type of a sheet. If the bottom sheet is a fitted sheet it will resemble a pocket with elastic corners that allow it to stretch around the top and sides of the mattress and to slightly tuck under the bottom edges and corners of the mattress.

Depending upon the weight and sleeping pattern of the person or persons using the bed, how well the fitted sheet is installed, the thickness of the mattress, and many other variables, the fitted sheet may become dislodged during normal use.

When it becomes dislodged, at least a portion of the fitted sheet is allowed to extend to the upper surface of the mattress where its presence is noticed by the person. The "feel" of the bed is thereby changed and the person using it notices that something is wrong and that it simply does not feel right.

This causes frustration for the person because it takes time and effort to strip the bed and to remake it, properly tucking the fitted sheet under the mattress prior to sleep.

There is a recent trend in mattresses to make them thicker by the addition of a "pillow top" which is either a padded or a quilted area that is attached to the top of the mattress. Standard types of fitted sheets may not adequately reach around the corners and sides of certain of the new thicker styles of pillow top or padded mattresses and be more prone to becoming dislodged.

If a fitted type of lower sheet is not used, then a flat lower sheet is used. It is tucked underneath the mattress at the sides, bottom, and even the top of the mattress to hold the flat lower sheet in position.

The top sheet is almost always a flat type of a sheet and it is tucked underneath the mattress at the sides and bottom, while typically leaving the top portion open to facilitate access therein.

The problem with all sheets is that they may become dislodged during use. As the user moves and stretches prior to falling asleep and also while he is sleeping, he is apt to pull the top sheet out of its proper position from underneath the mattress. The user then finds that the sheet or sheets "ride" up over his feet and legs, as was mentioned hereinabove. This produces an uncomfortable sensation that may serve as an impediment to resting.

Often to help ensure that the sheets stay in place, the person making the bed will very tightly tuck the sheets under the mattress. However, the person using the bed finds this especially constraining. Instead of the "feel" between the sheets being one of comfort, the space feels cramped and tight. Almost instinctively, the person immediately bends his legs and pulls on the sheets so as to obtain more space to move. Doing so, he immediately dislodges the sheets to some degree. It may not require much more movement on the part of the person in order to fully dislodge a corner of one of the sheets.

Keeping the sheets properly tucked under the mattress is a problem for which no satisfactory solution has been found.

Elastic straps that attach to diametrically opposed edges of the sheet at each of the bottom corners is the only known prior art. However, the use of the elastic straps requires that a portion of the mattress at the corners, be elevated a amount sufficient to allow the person to attach the clips that are disposed at the ends of the elastic strap to opposite edges of the sheet.

Not only are the mattress corners heavy and awkward to lift, they must be held (i.e., retained) in the elevated position under the clips are fully secured to the sheet.

When attempting to lift a corner of the mattress, the mattress bends in an arc to allow this to occur. As the mattress is not intended to flex in this manner, an additional strain is imposed upon the person having to hold the mattress in the air and attach the clips to the sheet.

Anyone who has used such an elastic clip type of a device is aware that attachment of it to the sheet is not easy to accomplish.

Also, many users find that the elastic clips do not adequately secure the sheet(s) in position. The clips often detach from the sheet when even a moderate force is exerted upon the sheet which then rides up over the person.

An ideal solution would secure either a flat or a fitted sheet (either a top or a bottom sheet or both) in position and it would resist any non-deliberate attempt to pull it out of position or to otherwise dislodge it.

A more effective way to secure a bed sheet in position is needed as is an easier method for securing the sheet.

One or more additional blankets or quilts are often placed atop the top sheet to provide added warmth. The sides and bottoms of the blankets and quilts are similarly tucked in under the mattress and similarly incur the same problems as were described hereinabove as occur with sheets.

Accordingly there exists today a need for a bed linen holder and method for retaining a portion of a sheet or a blanket under a mattress in a desired position and which does not require attachment of the device to the sheet while the mattress corner is held in an elevated position. Ideally, the device would also be attractive in appearance.

Clearly, such an apparatus and method would be useful and desirable.

2. Description of Prior Art

Bed linens and elastic clips to hold bed sheets in position are, in general, known. While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a bed linen holder and method that is adapted to retain a sheet in its desired position proximate a mattress.

It is also an important object of the invention to provide a bed linen holder and method that is adapted to retain a blanket in its desired position proximate a mattress.

Another object of the invention is to provide a bed linen holder and method that is adapted to retain a quilt or a comforter in its desired position proximate a mattress.

Still another object of the invention is to provide a bed linen holder and method that is easy to use.

Still yet another object of the invention is to provide a bed linen holder and method that is inexpensive to manufacture.

Yet another important object of the invention is to provide a bed linen holder and method can be adapted for use with a variety of different types of bed linens.

Still yet another important object of the invention is to provide a bed linen holder and method that eliminates the need to retain a mattress in an elevated position while attaching the bed linen holder to the linen (i.e., the sheet, blanket, quilt, or other type of a bed linen).

One still further object of the invention is to provide a bed linen holder and method that adapted for use with various sizes and types of beds.

One still yet further object of the invention is to provide a bed linen holder and method that is attractive in appearance.

Briefly, a bed linen holder and method that is constructed in accordance with the principles of the present invention has a planar member with a tapered portion that is adapted to receive a portion of a bed linen therein. As the linen is drawn toward the narrow portion of the taper, it is increasingly secured to the planar member. The planar member is then rotated in an arc and placed under a corner of a mattress. The tapered portion may be disposed wholly in the planar member or the widest part of the tapered portion may be disposed on an outside edge of the planar member. A preferred appearance of the planar member includes a heart shape (plan view) with the tapered portion being disposed intermediate the top of the heart. According to an alternate embodiment, the planar member resembles a rectangle (plan view) and includes a plurality of different sizes of the tapered portions disposed proximate the corners thereof.

DETAILED DESCRIPTION OF THE INVENTION

Figure 1:
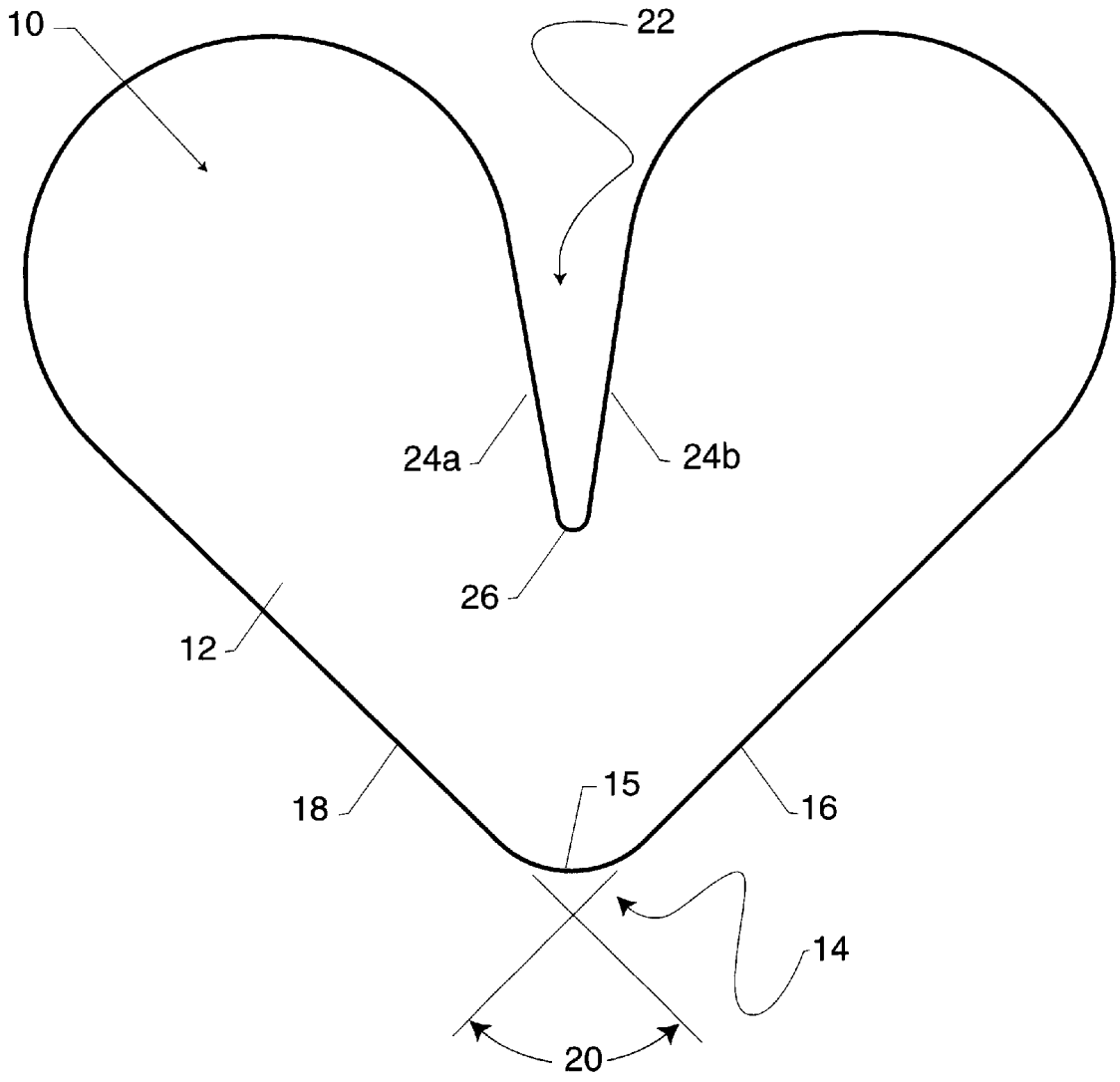
FIG. 1 is a plan view of a preferred form of a bed linen holder.

Referring on occasion to all of the FIGURE drawings and in particular now to FIG. 1 is shown, a preferred form of a bed linen holder, identified in general by the reference numeral 10.

The bed linen holder 10 includes a planar member 12 that is formed of a desired material, the type and size being selected to suit. For some applications, a plastic material may be desirable. For other applications, a wooden material may be preferred. For yet other applications, other materials may be used.

The thickness of the planar member 12 is preferably as small as possible but it is not critical and a great deal of design variability is possible. A range of from approximately 1/16 of an inch to 1/4 of an inch thick are common however, it is to be understood that thicker as well as thinner versions of the planar member 12 are possible.

The overall shape of the planar member 12 (top view) is that of a typical heart shape. This is because most people find a heart shape to be endearing, having had many favorable associations over the course of their life involving that shape.

Of course, other shapes including any type of a polygon may also be used to form the planar member 12, one of which is described in greater detail hereinafter.

The planar member 12 includes a nose area, identified in general by the reference numeral 14. The nose area 14 preferably includes a radius 15.

The planar member includes a first side 16 and a second side 18 which merge towards each other proximate the nose 14 and are connected by the radius 15.

The angle intermediate the first and the second sides 16, 18 is preferably ninety degrees as shown by arrow 20. This is preferred because each corner of a mattress 30 (FIGS. 3 through 5) include a ninety degree angle. This is described in greater detail hereinafter.

Angles other than ninety degrees may, of course, be used intermediate the first and second sides 16, 18.

Disposed opposite the nose 14 is a tapered portion, identified in general by the reference numeral 22. The tapered portion 22 includes a pair of opposing sides 24*a*, 24*b* that are widest (i.e., disposed furthest away from each other) at a first end that is furthest away from the nose 14 and is proximate an outside of the planar member 12 and they are closest to each other at a second end that is nearest the nose 14 and which is disposed well within the planar member 12.

A second radius 26 connects the pair of tapered sides 24*a*, 24*b* at their closest location, in the planar member 12.

The space intermediate the pair of opposing sides 24*a*, 24*b* of the planar member 12 is varied to best suit the task at hand. If the bed linen holder 10 is used to secure a flat sheet 28*a* (See FIG. 3), the size of the opposing sides 24*a*, 24*b*, the distance between them, as well as the overall size of the planar member 12 are minimal.

If, however, the bed linen holder 10 is used to secure a blanket 28*b* (See FIG. 4), the size of the opposing sides 24*a*, 24*b*, the distance between them, as well as the overall size of the planar member 12 are increased.

If the bed linen holder 10 is used to secure a quilt 28*c* (See FIG. 5), the size of the opposing sides 24*a*, 24*b*, the distance between them, as well as the overall size of the planar member 12 are maximal.

Figure 3:
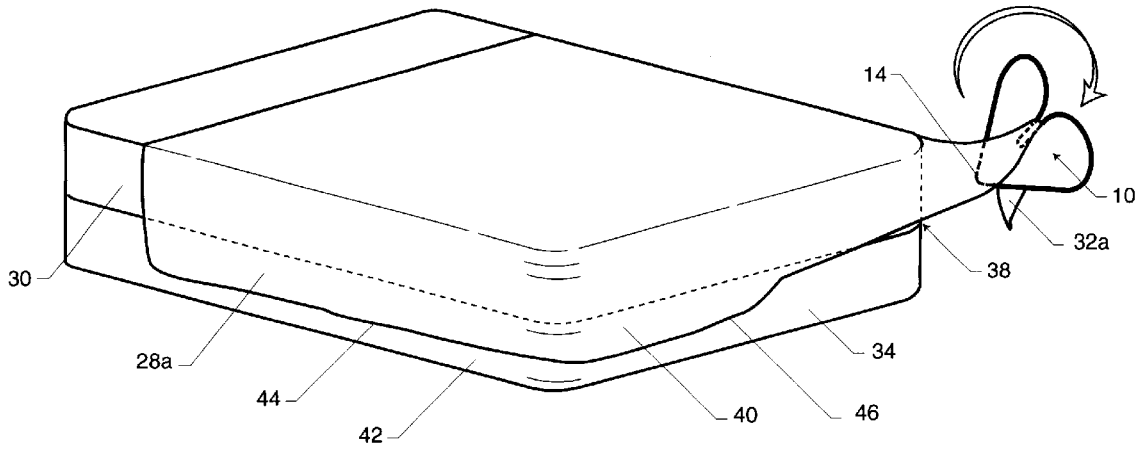
FIG. 3 is a first step of securing the linen to the bed linen holder.
Figure 4:
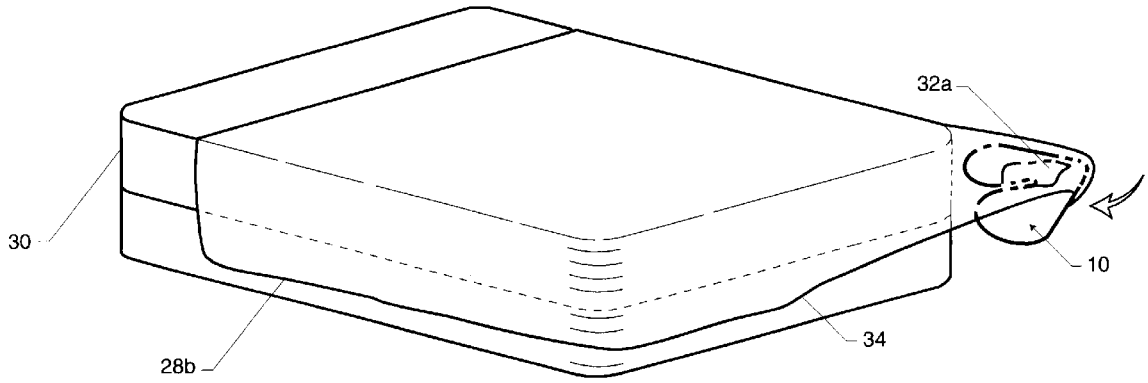
FIG. 4 is an optional and preferred second step of rotating the bed linen holder approximately 180 degrees.
Figure 5:
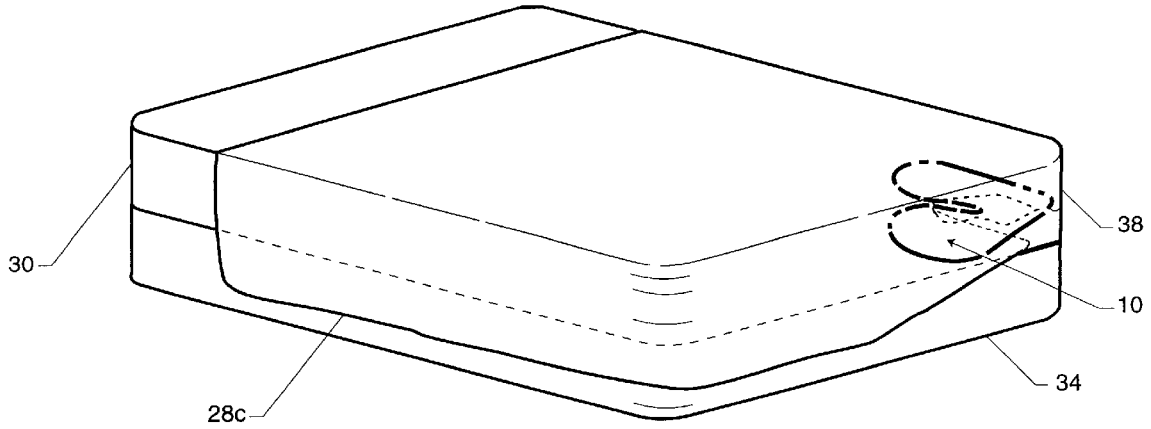
FIG. 5 is a third step of placing the bed linen holder under a corner of a mattress.

Referring now to FIGS. 3–5, the method steps for securing a bed linen (sheet 28*a*, blanket 28*b*, quilt 28*c*) proximate the mattress 30 are shown.

The method begins with insertion of a first corner 32*a* of the sheet 28*a* into the tapered portion 22 of the planar member 12 and securing it to the bed linen holder 10. To begin this step, the planar member 12 is held nearly flat and the nose 14 is toward the mattress 30.

The step is then further accomplished by gathering a portion of the material of the sheet 28*a* and by pressing the gathered material into the tapered portion 22 and pulling it toward the center (i.e., the narrowest part) of the tapered portion 22. The tapered portion 22 increasingly pinches the gathered material thus securing the sheet 28*a* to the bed linen holder 10.

The wider portion of the tapered portion 22 facilitates insertion of the gathered material therein and the increasingly narrow taper that occurs intermediate the pair of opposing sides 24*a*, 24*b* ensures that as the gathered material is forced further into the tapered portion 22, the first corner 32*a* of the sheet 28*a* will be adequately secured therein.

The previously described method of attaching the sheet 28*a* to the bed linen holder 10 is identical when either the blanket 28*b* or the quilt 28*c* or any other type of a bed linen (not shown) is used.

To remove the bed linen holder 10 from the sheet 28*a* (or the blanket 28*b* or the quilt 28*c*), the gathered material is grasped and the first corner 32*a* of the sheet 28*a* is pulled away from the narrow portion of the tapered portion 22 and toward the wide portion of the tapered portion 22 sufficient to detach the sheet 28*a* from the bed linen holder 10.

A box spring 34 is not required, however for purposes of clarity the box spring 34 is shown under the mattress 30.

The second step (FIG. 4), shows the bed linen holder 10 after it has been rotated approximately 180 degrees as shown by a second arrow 36 (FIG. 3). To rotate the bed linen holder 10, the nose 14 is lifted in an arc away from the mattress 30. This motion is continued until nose 14 is disposed maximally away from the mattress 30.

The bed linen holder 10 is also lowered so that its plane aligns with a plane intermediate the bottom of the mattress 30 and the top of the box spring 34.

The third step (FIG. 5) includes inserting the bed linen holder 10 intermediate the mattress 30 and the box spring 34 at the first mattress corner 38 by sliding the holder 10 (with the sheet 28*a* attached thereto) under the mattress corner 38. If desired, the first mattress corner 38 may also be raised slightly to ease installation.

The first corner 32*a* of the sheet 28*a* is then neatly and firmly secured in position.

The previously described steps are performed at a second corner 40 (FIG. 3) and at a second mattress corner 42. A pair of sides 44 (only one shown) of the sheet 28*a* and a bottom 46 of the sheet 28*a* are also tucked in intermediate the mattress 30 and the box spring 34 to fully secure the sheet 28*a* proximate the mattress 30.

If a user (not shown) pulls on either the first corner 32*a* or the second corner 40, this effectively serves to further embed the sheet 28*a* into the bed linen holder 10. This provides a most reliable way of securing a bed linen (28*a–c*) in position under the first mattress corner 38.

The previous steps are identical whether the sheet 28*a*, the blanket 28*b*, or the quilt 28*c* are used. It is noted that all of the steps are performed to either the sheet 28*a*, the blanket 28*b*, or the quilt 28*c*, depending upon which type of a bed linen is being secured.

Figure 2:
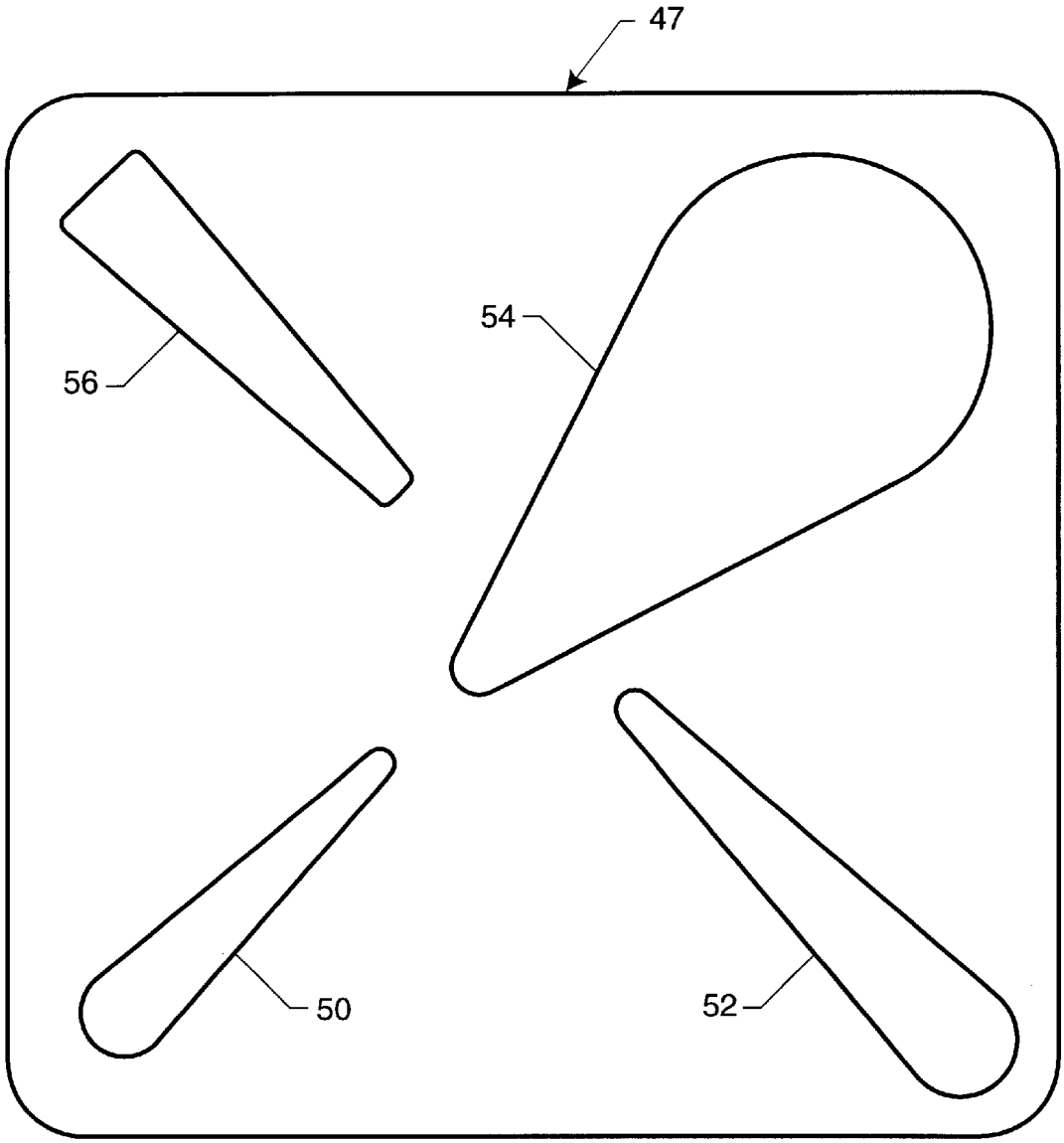
FIG. 2 is a plan view of an alternate embodiment thereof including a sampling of additional shapes for the tapered portion.

There are many variations possible for the shape of the bed linen holder 10 and for the shape and location of the tapered portion 22. While it is not possible to describe all such possible embodiments, referring now to FIG. 2 is shown a modified bed linen holder 47 that includes a modified planar member 48. The modified planar member 48 resembles a either a square or a rectangle (plan view).

The modified planar member 48 includes a first interior tapered portion 50, a second interior tapered portion 52, a third interior tapered portion 54, and a fourth interior tapered portion 56, all of which are openings that are formed through the modified planar member 48.

The first, second, and third interior tapered portions 50, 52, 54 each have a "tear-drop" shape with a narrow portion that is disposed toward the center of the modified planar member 48 and a wide portion that is disposed away from the center and tapered sides therebetween.

The first interior tapered portion 50 is the smallest of the three tear drop shaped interior tapered portions and it is, accordingly, designed to secure the sheet 28*a* therein. When the modified bed linen holder 47 is used, the first corner 32*a* of the sheet 28*a* must be gathered and then pulled through the widest part of the first interior tapered portion 50 before it is forced into the narrower portion thereof.

Unlike the tapered portion 22 shown in FIG. 1, the entire first, second, third, and fourth interior tapered portions 50, 52, 54, 56, including the wide portions thereof, are fully contained within the modified planar member 48.

The second interior tapered portion 52 is of an intermediate size and it is, accordingly, designed to secure the blanket 28*b* therein.

The third interior tapered portion 54 is the largest of the three tear drop shaped interior tapered portions and it is, accordingly, designed to secure the quilt 28*c* therein.

The fourth interior tapered portion 56 resembles a trapezoid with the narrowest parallel segment of the trapezoid disposed near the center of the modified planar member 48 and the widest parallel segment of the trapezoid disposed furthest away from the center of the modified planar member 48. If the sides of the trapezoid were extended to a point, a triangle is formed as another possible shape for the fourth interior tapered portion.

The fourth interior tapered portion 56 shows that the tear-drop shape is not mandatory. What is required are the two sides of any of the tapered portions 22, 50–56 that are disposed in other than a parallel relationship and where the narrowest portion thereof is, preferably, disposed closest toward the inside of the bed linen holder 10 or of the modified bed linen holder 47.

The bed linen holder 10 or the modified bed linen holder 47 are used to attach a portion, usually a corner, of the bed linen 28*a–c* to the holder 10, 47 and to secure that portion under the mattress 30. Typically, a plurality of the holders 10, 47 are used to secure a plurality of corners in place. For a top sheet 28*a*, usually a second bottom corner 32*b* is typically also secured in position with another holder 10, 47.

Accordingly, for most applications at least two of the holders 10, 47 are required. For certain applications, the top two corners are also secured (i.e., for a bottom flat sheet) and so a total of four of the holders 10, 47 will be needed.

For certain applications, such as for people who toss and turn a great deal during sleep, it may be desirable to also secure either one or both of the pair of sides 44 under the mattress 30. If this is desired, a portion of the material of the sheet 28*a* is gathered together along each of the pair of sides 44 and the gathered portion is attached to additional holders 10, 47 that are then placed under the mattress 30 proximate the pair of sides 44.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A bed linen holder, comprising:

(a) a planar member; and (b) a tapered portion wherein said tapered portion forms an opening in said planar member and wherein said opening includes a first end having a first distance intermediate a pair of opposing sides and a second end distally disposed with respect to said first end, said second end having a second distance intermediate said pair of opposing sides and wherein said first distance is greater than said second distance and wherein said second end of said tapered portion is contained within an interior of said planar member and wherein said first end is disposed at an outer edge of said planar member, wherein said first end of said tapered portion includes an opening at said outer edge and wherein said tapered portion is configured to receive and to retain said bed linen when said bed linen is inserted into said first end and is displaced a predetermined distance toward said second end of said tapered portion.

2. The bed linen holder of claim 1 wherein said planar member includes a heart-shape.

3. The bed linen holder of claim 2 wherein said planar member includes a first side and a second side which merge towards each other at an angle and extend toward a nose portion, said nose portion including a radius and wherein one end each of said first side and said second side are connected at opposite ends of said radius.

4. The bed linen holder of claim 3 wherein said angle is approximately ninety degrees.

5. The bed linen holder of claim 1 wherein said tapered portion is contained within said planar member.

6. The bed linen holder of claim 5 wherein said tapered portion includes a tear-drop shape.

7. The bed linen holder of claim 5 wherein said tapered portion includes a triangular shape.

8. The bed linen holder of claim 1 wherein said tapered portion includes a plurality of tapered portions.

9. The bed linen holder of claim 1 wherein said planar member includes a rectangular shape.

10. The bed linen holder of claim 1 wherein said planar member includes a square shape.

11. The bed linen holder of claim 1 wherein said planar member includes a polygonal shape.

12. A method for securing a bed linen, comprising the steps of:

(a) attaching a portion of said bed linen to a substantially planar member wherein said substantially planar member includes a tapered portion and wherein said tapered portion forms an opening in said planar member and wherein said opening includes a first end having a first distance intermediate a pair of opposing sides and a second end distally disposed with respect to said first end, said second end having a second distance intermediate said pair of opposing sides and wherein said first distance is greater than said second distance and wherein said second end of said tapered portion is contained within an interior of said planar member and wherein said first end is disposed at an outer edge of said planar member, wherein said first end of said tapered portion includes an opening at said outer edge and wherein said tapered portion is configured to receive and to retain said bed linen; and (b) placing said planar member under a mattress.

13. The method for securing a bed linen of claim 12 wherein the step of attaching a portion of said bed linen includes the step of urging said portion of said bed linen further into a tapered portion that is provided in said planar member sufficient to retain said portion of said bed linen to said planar member.

14. The method for securing a bed linen of claim 12 wherein the step of attaching a portion of said bed linen includes the step of gathering a quantity of said bed linen together followed by the additional step of urging said quantity of said bed linen further into a tapered portion that is provided in said planar member sufficient to retain said quantity of said bed linen to said planar member.

15. The method for securing a bed linen of claim 14 wherein the step of gathering a quantity of said bed linen together includes the additional step of gathering a quantity of said bed linen together at a corner of said bed linen.

16. The method for securing a bed linen of claim 12 wherein the step of placing said planar member under a mattress includes the step of placing said bed linen under a corner of said mattress.

17. The method for securing a bed linen of claim 12 including the additional step of repeating said two steps at a second location of said bed linen.

18. The method for securing a bed linen of claim 12 including the additional step of securing a second bed linen and of repeating said two steps for said second bed linen.

19. The method for securing a bed linen of claim 12 including the addition step of rotating said planar member approximately 180 degrees after performing the step of attaching said portion of said bed linen to said substantially planar member and prior to performing the step of placing said planar member under said mattress.

* * * * *